United States Patent [19]

Samal

[11] Patent Number: 4,594,217

[45] Date of Patent: Jun. 10, 1986

[54] DIRECT POWDER ROLLING OF DISPERSION STRENGTHENED METALS OR METAL ALLOYS

[75] Inventor: Prasanna K. Samal, Lyndhurst, Ohio

[73] Assignee: SCM Corporation, New York, N.Y.

[21] Appl. No.: 709,102

[22] Filed: Mar. 7, 1985

[51] Int. Cl.[4] ..... B22F 5/00

[52] U.S. Cl. ..... 419/3; 419/19; 419/23; 419/28; 419/29; 419/39; 419/43; 419/53; 419/54; 419/55; 419/57; 419/69

[58] Field of Search ..... 419/3, 19, 23, 28, 29, 419/43, 39, 53, 55, 54, 57, 69

[56] References Cited

U.S. PATENT DOCUMENTS

| | | | |
|---|---|---|---|
| 2,621,123 | 12/1952 | Hoyer | 419/55 |
| 3,306,242 | 2/1967 | Adams et al. | 419/55 |
| 3,396,015 | 8/1968 | LaPlante | 419/55 |
| 3,720,511 | 3/1973 | Davies et al. | 419/55 |
| 3,839,026 | 10/1974 | Gibbon et al. | 419/55 |

*Primary Examiner*—Stephen J. Lechert, Jr.

*Attorney, Agent, or Firm*—R. A. Sturges; T. M. Schmitz

[57] ABSTRACT

A process for making a strip or sheet comprising dispersion strengthened metal or dispersion strengthened metal alloy which comprises rolling directly from dispersion strengthened metal powder to a green strip or sheet density of from at least 90% to 95% of theoretical density, sintering the green strip or sheet in an inert atmosphere at a temperature and for a period of time sufficient to form a rigid body; reducing the thickness of the strip or sheet by at least 25% by cold rolling or hot rolling and resintering at sintering temperature of at least about 1800° F. for 40 to 75 or more minutes.

4 Claims, No Drawings

DIRECT POWDER ROLLING OF DISPERSION STRENGTHENED METALS OR METAL ALLOYS

This invention relates to the process for direct powder rolling of dispersion strengthened copper (DSC) powder for making full-dense strips.

BACKGROUND OF THE INVENTION AND PRIOR ART

Rolling of metal powders by directly feeding them into the roll-gap or nip of a rolling mill, has been demonstrated as a commercial process for making wrought metal strips of various metals and alloys. Broadly, the process involves roll compaction of the desired metal or alloy powder, followed by strand or coil sintering, rerolling (cold), resintering and finish rolling. Commercial processes based on this general principle are in use for making strips from nickel powder, cobalt powder, iron-nickel alloy powders, etc. The key steps in these processes are: (a) roll compaction of the powder which should result in a continuous greenstrip having sufficient green strength for subsequent processing and uniform green density, and (b) sintering of the roll compacted green strip to achieve sufficient interparticle bonding so that the strip can withstand subsequent densification by cold rolling. Typically, the roll compacted green strip will have a density in the range of 72 to 82% of the theoretical full density.

A variation of the above described powder rolling process also exists, in which the roll compacted strip is hot rolled to achieve full theoretical density, instead of sintering and cold rolling. However, this approach is not very practical (and hence is rarely practiced commercially) due to the facts that (a) extreme care must be taken to prevent the porous green strip from getting oxidized either during pre-heating or hot-rolling (the entire hot rolling stand would be required to be kept under controlled atmosphere) and (b) it is difficult to achieve a precise matching of the speeds of the two rolling mills, without which the porous unsintered strip will be pulled apart.

Direct powder rolling of dispersion strengthened copper powder poses some unique problems as compared to metals and alloys that are currently processed by powder rolling. The major difference lies in the fact that dispersion strengthened copper powder does not sinter nearly as well as these other metal and alloy powders do. Dispersion strengthened copper powder consists of a $Al_2O_3$ rich layer on the surface of the particles (which inherently develops during the internal oxidation step) that prevents sintering. Additionally, the $Al_2O_3$ dispersoids present in the matrix of the material prevent grain growth even at very high temperatures, which affects sinterability.

BRIEF STATEMENT OF THE INVENTION

Briefly stated, the present invention is in a process for making a strip comprising dispersion strengthened metal or dispersion strengthened metal alloy having a density which is at or near theoretical density and which comprises rolling directly from said, metal or metal alloy as a powder having a particle size in the range of −80 to +400 mesh (Tyler Sieve Size) to a green strip with a density of from about 90% to 95% of theoretical density, sintering the green strip in an inert atmosphere at a temperature and for a period of time sufficient to cause the particles to adhere and form a solid body, reducing the thickness of the body by rolling, and re-sintering the rolled body in an inert atmosphere.

DETAILED DESCRIPTION OF THE INVENTION AND SPECIFIC EXAMPLES

The present invention overcomes these problems of poor sinterability of dispersion strengthened copper powder, by the optimum control of various process parameters. In the roll compaction step, a much higher green density than is used for other metals, is utilized. The green strip is rolled at a density of 90 to 95% of theoretical full density in this case, as against 70 to 82% prescribed for most other metal powders. The higher green density not only results in greater number of interparticle contact points for sintering to occur at, but also subjects the powder particles to substantial amount of cold deformation. The more or less spherical particles are deformed into flat disc shaped (somewhat elongated too) particles, under the fairly high compressive forces exerted, resulting in an increase in the surface area of the individual particles. New, clear surfaces, essentially free from $Al_2O_3$ rich layers thus become available for aiding in the sintering process. The partially sintered strip is rerolled to full theoretical density (from the initial 90–95% level). During this rerolling the individual particles stretch out substantially (30% or more increase in length), creating additional new, clean—$Al_2O_3$ free surfaces. The partially sintered strip however must have sufficient sinter strength to undergo such large deformations without cracking.

Hence the most critical parameters are the high initial green density, the presintering parameters (time period and temperature), the rerolling schedule and the final sintering parameters. These parameters are illustrated in the specific examples below.

As indicated above, the present invention contemplates the use of a dispersion strengthened metal, particularly copper, as the core material which is densified in the course of carrying out the process of the present invention. Other dispersion strengthened metals such as nickel, steel, and the like may also be used in the process of this invention. For most purposes, we prefer to use a dispersion strengthened copper powder having a particle size of less than about 20 mesh (Tyler screen size) preferably from 40 mesh to 400 mesh, e.g., 200 mesh average, which material has been internally oxidized prior to its entry into the process. Dispersion strengthened copper produced by other methods may also be used and in some cases may contain from 0.1% up to about 0.4% or 0.5% aluminum as aluminum oxide. As we have stated above, internal oxidation of the copper alloy (copper aluminum) may occur during the size reduction operation by elevating the temperature during size reduction to a temperature above about 1000° F., for example, a temperature of from 1200° to 1800° F. for a period of time sufficient to cause reaction between the solute metal (aluminum) and the oxidant (cuprous oxide), provided therein. Although the present invention process will be described in connection with dispersion strengthened copper, it will be understood that the principles and procedures of the present invention are applicable as well to other dispersion strengthened metal powders. Thus, iron, nickel, silver, etc., may be dispersion strengthened with a refractory oxide, such as, aluminum oxide, titanium dioxide, magnesium oxide, silicon dioxide, zirconium oxide, beryllium oxide, and the like.

The advantages of the present invention are realized to the best extent where the amount of solute metal in the form of refractory oxide dispersed within the matrix metal, e.g., copper, iron, cobalt, nickel or alloys thereof, is within the range of from about 0.1% to as high as about 0.5% by weight. Where the dispersion strengthened metal is internally oxidized dispersion strengthened copper, commercially available examples thereof are identified as "Glidcop" AL-15, AL-20, and AL-35. "Glidcop" is a registered trademark of SCM Corporation. These materials are copper based and contain respectively 0.15%, 0.2%, and 0.35%, aluminum as aluminum oxide dispersed within the copper matrix. They can be produced by internal oxidation as described in Nadkarni et al. U.S. Pat. No. 3,779,714, Nadkarni, U.S. Pat. No. 4,315,770 or Klar et al. U.S. Pat. No. 4,462,845 all of which are incorporated herein by reference and are commonly owned with the present application.

The dispersion strengthened metal may be an alloy which is prepared prior to introduction into the rolling mill as a powder, or, the powder may comprise powdered dispersion strengthened copper and an additional powdered metal. If under the conditions of heating, and sintering the additional metal forms an alloy with the dispersion strengthened copper, useful products can be produced. Thus, for example, a mixture of 90% "Glidcop" AL-15, with 5% tin powder will yield quite readily a consolidated product of dispersion strengthened copper/tin alloy, and when the principles of the present invention are applied, cracking during rolling is avoided. Reference may be had to U.S. Pat. No. 4,440,572 for further examples of alloys prepared from powder compositions.

The principles of the present invention can be applied as well to composites wherein the powdered dispersion strengthened copper is mixed prior to sintering with a non-alloyable powdered substance such as a hard metal, for example, iron/nickel alloy to form a consolidated composite structure. In these cases, the product is characterized by relatively high mechanical strength, high electrical and thermal conductivity and a low coefficient of thermal expansion. For example, 60 parts of Glidcop AL-20 powder screened to −80/+400 mesh is thoroughly mixed with 180 parts of −80/+400 mesh nickel/iron (42%:58% iron, and the powders thoroughly blended. The blended powders may be consolidated by rolling to less than full density in accordance with the principles of the present invention. Reference may be had to commonly owned application Ser. No. 561,035 filed Dec. 13, 1983 for further examples of composite powders useful herein.

Thus, the principles of the present invention are applicable to dispersion strengthened copper powders; alloyable compositions of dispersion strengthened copper powder and a metal alloyable therewith by heat; and composite compositions of dispersion strengthened copper powder and a non-alloyable discretely distributed particulate in a composite structure. Such powders are ultimately consolidated to substantially full density by sintering and rolling as described herein.

When the dispersion strengthened copper metals of the present inventions are substantially completely densified, i.e., 98% to 100% of theoretical density, they should have a tensile strength at room temperature of at least about 50,000 psi. Obviously, in a partially densified state, the dispersion strengthened copper or dispersion strengthenable copper will not have a tensile strength of this magnitude. When fully densified, "Glidcop" AL-15, for example, develops a tensile strength in the range of from 55,000 to 60,000 psi at room temperature.

EXAMPLE 1

This is an example following prior rolling technique with AL-15 dispersion strengthened copper.

I. Green strip density 85%—0.10" thick, cut into 3 lengths.

II.
- (a) Sintered at 1850° F. for 15 minutes, in nitrogen.
- (b) Sintered at 1850° F. for 30 minutes, in nitrogen.
- (c) Sintered at 1850° F. for 60 minutes, in nitrogen.

III. Rerolled by 4 passes, resulting in total reduction in thickness of 25%.

IV. Resintered at 1800° F. for 60 minutes, in nitrogen.

V. Cold roll by 10% reduction per pass to 0.030".

Results: All strips showed severe cracking. Sample (c) showing least severe cracking.

EXAMPLE 2

This example shows the effect of rolling to a slightly higher density using AL-15 "Glidcop" dispersion strengthened copper.

I. Green strip density 90%—0.10" thick.

II. Sintered at 1850° F. for 60 minutes in nitrogen.

III. Cold rolled by 4 passes, resulting in a net reduction in thickness of 25%.

IV. Resintered at 1800° F. for 60 minutes.

V. Cold rolled by taking approximately 10% reduction per pass to 0.030".

Result: Finished strip does not show cracks but extremely brittle and could not be rolled further.

Conclusion from Examples 1 and 2: Green density of 90% or greater is essential for sintering.

EXAMPLE 3

This example shows the effect of rolling AL-15 DSC powder to a higher initial density and to a somewhat greater reduction in thickness following the sintering step.

I. Green strip density 90%, 0.10" thick.

II.
- (a) Sintered at 1800° F. for 10 minutes in nitrogen.
- (b) Sintered at 1800° F. for 20 minutes in nitrogen.
- (c) Sintered at 1800° F. for 30 minutes in nitrogen.
- (d) Sintered at 1800° F. for 40 minutes in nitrogen.

III. Cold rolled by 4 passes resulting in a total reduction in thickness of 33%.

IV. Resintered at 1800° F. for 60 minutes.

V. Cold rolled to 0.030" taking 10% reduction per pass.

Result: All strips were crack free and ductile enough to be further rolled to 0.010". After rolling to 0.010" all strips were annealed at 1400° F. for 1 hour in nitrogen atmosphere and bend tested over a 0.010" radius mandrel.

Strip (a)

Transverse bends to failure 7, 8.
Longitudinal bends to failure 3, 3.

Strip (b)

Transverse bends to failure 7½, 9½.
Longitudinal bends to failure 3½, 3½.

Strip (c)

Transverse bends to failure 9½, 11.
Longitudinal bends to failure 4½, 4½.

Strip (d)

Transverse bends to failure 10, 9½.
Longitudinal bends to failure 4½, 5.

Conclusion: Cold rolling by 33%, instead of 25%, resulted in superior ductility permitting the strip to be rolled to 0.010".

EXAMPLE 4

This example illustrates the effect of sintering temperature together with higher initial green strip density and increased to reduction in thickness. Again, AL-15 dispersion strengthened powder was used.

I. Green strip density 90%—0.10" thick.

II.
(a) Sintered at 1850° F. for 3 minutes in nitrogen.
(b) Sintered at 1850° F. for 3 minutes in nitrogen.
(c) Sintered at 1850° F. for 6 minutes in nitrogen.
(d) Sintered at 1850° F. for 6 minutes in nitrogen.

III. After sintering samples (b) and (d) were wrapped around a 3' dia. mandrel to simulate coiling.

IV. Cold rolled all samples by 4 passes resulting in a total reduction in thickness of 33%.

V. Re-sintered at 1800° F. for 60 minutes, in nitrogen.

VI. Cold rolled to 0.010", taking approximately 10% reduction per pass.

VII. Bend tested over a 0.010" radius mandrel, both in the as rolled condition (shown in parenthesis) and after annealing at 1400° F. for 45 minutes.

| Results: | No. of Bends to Failure | |
|---|---|---|
| Sample | Transverse | Longitudinal |
| a | 8½, 9½, (7½, 9) | 3½, 4½, (2, 2½) |
| b | 8, 9, (8½, 7½) | 3, 3½, (1½, 1½) |
| c | 10, 9½, (7, 8½) | 4, 5½, (3, 3) |
| d | 10, 9½, (8, 8) | 4½, 5, (2½, 3) |

Conclusion (Based on Examples 3 and 4): Pre-sintering time period of 10 minutes is not adequate, when sintering temperature is 1800° F.

EXAMPLE 5

This is the best mode of carrying out my invention.

I. Green strip density 90%—0.10" thick.

II.
(a) Sintered at 1850° F. for 3 minutes in nitrogen.
(b) Sintered at 1850° F. for 3 minutes in nitrogen.
(c) Sintered at 1850° F. for 6 minutes in nitrogen.
(d) Sintered at 1850° F. for 6 minutes in nitrogen.

III. After sintering samples (b) and (d) were wrapped around a 3' dia. mandrel to simulate coiling.

IV. Cold rolled all samples by 4 passes resulting in a total reduction in thickness of 33%.

V. Re-sintered at 1800° F. for 60 minutes, in nitrogen.

VI. Cold rolled to 0.040" from 0.067", taking 10% reduction per pass.

VII. Resintered all strips at 1800° F. for 45 minutes in nitrogen atmosphere.

VIII. Rerolled to 0.010", taking 10% reduction per pass.

IX. Bend tested over a 0.010" radius mandrel both in the as-rolled condition (in parenthesis) and after annealing at 1400° F.

| Results: | No. of Bends to Failure | |
|---|---|---|
| Sample | Transverse | Longitudinal |
| a | 10, 11, (8, 9) | 3½, 3½, (3, 2½) |
| b | 9½, 11, (7½, 9½) | 3½, 4½, (2, 3) |
| c | 9½, 9½, (8, 7) | 3½, 4, (3, 4) |
| d | 8, 9½, (8, 7) | 4½, 3½, (3, 3) |

Conclusion: In order to be able to reduce the presintering time period to as short as 3 and 6 minutes, presintering temperature needs to be raised to 1850° F. because, after the pre-sintering, the strip will have to be coiled (to avoid tensioning between 2 rolling mill stands) on a 3 to 4 diameter core, a minimum pre-sintering period of 6 minutes is essential when two sintering steps are incorporated. Alternately, when only 3 minutes of presintering is provided, a 3rd sintering step is essential to produce strips with satisfactory ductility.

What is claimed is:

1. A process for making a strip comprising dispersion strengthened metal or dispersion strengthened metal alloy said dispersion strengthened metal or dispersion strengthened metal alloy containing from about 0.1 to about 0.5% by weight of a refractory metal oxide calculated as the metal dispersed throughout the metal or metal alloy having a density which is at or near theoretical density and which comprises rolling directly from said metal or metal alloy as a powder having a particle size in the range of −80 to +400 mesh (Tyler Sieve Size) to a green strip with a density of from about 90% to 95% of theoretical density, sintering the green strip in an inert atmosphere at a temperature and for a period of time sufficient to cause the particles to adhere and form a solid body, reducing the thickness of the body by rolling, and resintering the rolled body in an inert atmosphere.

2. A process as defined in claim 1 wherein the dispersion strengthened metal is dispersion strengthened copper or a dispersion strengthened alloy of copper and a metal alloyable therewith.

3. A process as defined in claim 1 wherein the resintered body is annealed at a temperature below sintering for from about 30 to about 75 minutes to improve ductility of the body.

4. A process as defined in claim 1 wherein the dispersion strengthened metal is a composite of dispersion strengthened metal and nonalloyable metal.

* * * * *